US010233944B2

(12) United States Patent
Lin et al.

(10) Patent No.: US 10,233,944 B2
(45) Date of Patent: Mar. 19, 2019

(54) IMPELLER STRUCTURE WITH IMPROVED ROTATION STABILITY

(71) Applicant: COOLER MASTER CO., LTD., New Taipei (TW)

(72) Inventors: Fu-Lung Lin, New Taipei (TW); Shui-Fa Tsai, New Taipei (TW); Tsung-Wei Lin, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 582 days.

(21) Appl. No.: 15/006,478

(22) Filed: Jan. 26, 2016

(65) Prior Publication Data

US 2017/0089359 A1 Mar. 30, 2017

(30) Foreign Application Priority Data

Sep. 25, 2015 (CN) ..... 2015 2 0749557 U

(51) Int. Cl.

| | |
|---|---|
| ***F01D 3/00*** | (2006.01) |
| ***F04D 29/58*** | (2006.01) |
| ***F04D 13/06*** | (2006.01) |
| ***F04D 29/041*** | (2006.01) |
| ***F04D 29/047*** | (2006.01) |
| ***F04D 29/22*** | (2006.01) |
| ***F04D 29/24*** | (2006.01) |
| ***F04D 29/043*** | (2006.01) |
| ***F04D 29/046*** | (2006.01) |
| ***F04D 29/42*** | (2006.01) |

(52) U.S. Cl.

CPC ..... *F04D 29/588* (2013.01); *F04D 13/0673* (2013.01); *F04D 29/043* (2013.01); *F04D 29/046* (2013.01); *F04D 29/0413* (2013.01); *F04D 29/0473* (2013.01); *F04D 29/2266* (2013.01); *F04D 29/242* (2013.01); *F04D 29/245* (2013.01); *F04D 29/4293* (2013.01)

(58) Field of Classification Search

CPC .. F04D 29/041; F04D 29/0416; F04D 29/225; F04D 29/2211; F04D 29/2216; F04D 1/025

USPC ..... 415/106

See application file for complete search history.

(56) References Cited

U.S. PATENT DOCUMENTS

| | | | | |
|---|---|---|---|---|
| 1,404,346 | A * | 1/1922 | Delery | 415/106 |
| 7,025,576 | B2 * | 4/2006 | Chaffee | A47C 27/082 417/366 |
| 7,416,525 | B2 * | 8/2008 | Wampler | F04D 29/047 600/16 |

(Continued)

*Primary Examiner* — Woody A Lee, Jr.
*Assistant Examiner* — Jason A Fountain
(74) *Attorney, Agent, or Firm* — Maschoff Brennan

(57) ABSTRACT

An impeller for used in a fluid pump device includes a shaft controlled to revolve in a first direction; an impeller body coupled to the shaft and driven by the revolving shaft to rotate, the impeller body having a top surface, a bottom surface and a circumferential surface; a first set of fluid-guiding members disposed on the top surface of the impeller body for driving a fluid to flow along a centrifugal direction of the revolving shaft; and a second set of fluid-guiding members disposed on the circumferential surface of the impeller body. Each or at least one of the second set of fluid-guiding members has a titling structure for driving the fluid to flow from the top to the bottom of the impeller along a designated path on the circumferential surface.

21 Claims, 10 Drawing Sheets

(56) References Cited

U.S. PATENT DOCUMENTS

| | | | | |
|---|---|---|---|---|
| 2011/0247502 | A1* | 10/2011 | Kobayashi | A61M 1/3627 96/219 |
| 2017/0058911 | A1* | 3/2017 | Baryshnikov | F04D 29/2288 |
| 2017/0130730 | A1* | 5/2017 | Torkildsen | F04D 29/051 |

* cited by examiner

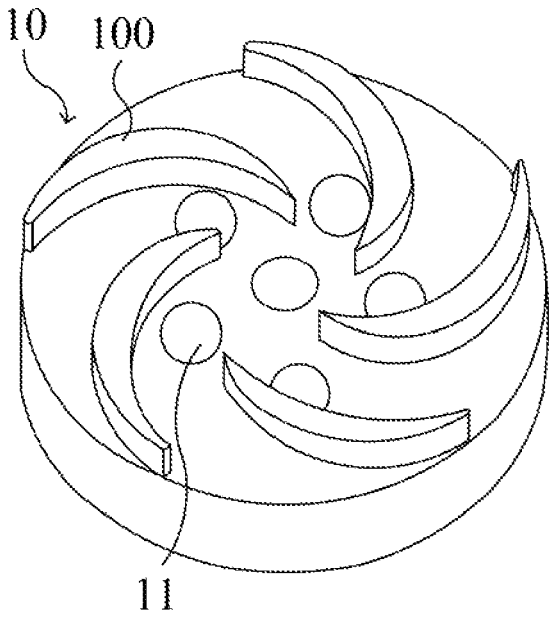
FIG. 2A（Prior Art）
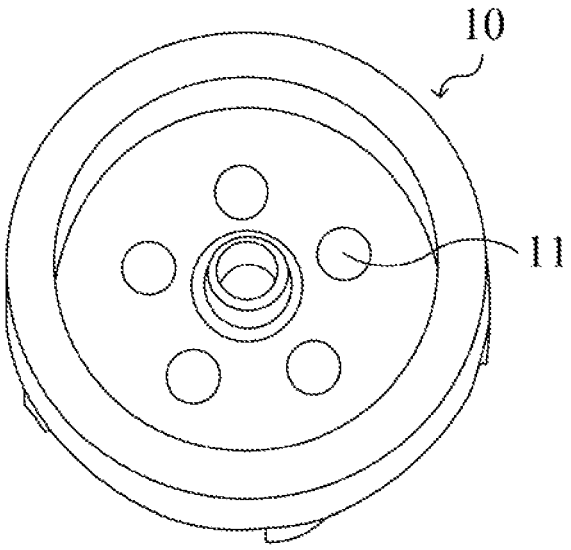
FIG. 2B（Prior Art）

IMPELLER STRUCTURE WITH IMPROVED ROTATION STABILITY

FIELD OF THE INVENTION

The present invention relates to an impeller, and more particular to an impeller used in an electronic system. The present invention also relates to a fluid pump, and further to a liquid cooling system, which are adapted to be used in an electronic system.

BACKGROUND OF THE INVENTION

Please refer to FIG. 1, in which a cross-sectional view of a water pump 1 commonly used in a water cooling heat-dissipating system of a conventional integrated circuit chip is schematically illustrated. As shown, the impeller 10 rotates clockwise to drive water inside the chamber of the water pump to flow along an arrow 19.

Further referring to FIG. 2A and FIG. 2B, the top structure and the bottom structure of the impeller 10 are schematically shown. As shown, a plurality of protruding blades 100 are arranged atop for driving the flow of the water cooling liquid. A plurality of through holes 11 are provided, penetrating the top face and the bottom face of the impeller 10, for the flow of the water cooling liquid into a channel space at the bottom of the impeller 10. While the water pump 1 is working, the water cooling liquid is thrown out due to a centrifugal force. Therefore, the water cooling liquid existing in the bottom space of the impeller 10 would be gradually decreasing. When the amount of the water cooling liquid inside the bottom chamber of the impeller 10 decreases to be less than a certain level, the pressure at the top and the bottom of the impeller 10 would become uneven, and the impeller 10 might deflect or unstable while rotating. As a result, the frictional force between the shaft 12 and the bearing 13 of the impeller would undesirably increase. Moreover, the presence of the through holes 11 of a relatively large diameter is also a factor resulting in liquid loss. The unsmooth rotation might result in unstable rotation speed and cause damages of the impeller, and further adversely affect the lift span of the water pump.

SUMMARY OF THE INVENTION

Therefore, the present invention provides an impeller, whose rotation can be maintained smooth.

The present invention also provides a fluid pump including an impeller with improved rotation stability.

The present invention further provides a liquid cooling system including an impeller with improved rotation stability.

In accordance with an aspect of the present invention, an impeller for used in a fluid pump, comprising: a shaft controlled to revolve in a first direction; an impeller body coupled to the shaft and driven by the revolving shaft to rotate, the impeller body having a top surface, a bottom surface and a circumferential surface; a first set of fluid-guiding members disposed on the top surface of the impeller body for driving a fluid to flow along a centrifugal direction of the revolving shaft; and a second set of fluid-guiding members disposed on the circumferential surface of the impeller body, and having at least one titling structure for driving a portion of the fluid to flow from the top to the bottom of the impeller along a designated path on the circumferential surface.

In accordance with another aspect of the present invention, a fluid pump comprises: a housing including a chamber, a fluid inlet and a fluid outlet, the fluid inlet and the fluid outlet being in communication with the chamber; and an impeller as described above.

In accordance with another aspect of the present invention, a fluid pump comprises: a housing including a chamber, a fluid inlet and a fluid outlet, the fluid inlet and the fluid outlet being in communication with the chamber; and an impeller as described above.

In accordance with a further aspect of the present invention, a liquid cooling system for dissipating heat from a heat accumulative object comprises: a heat exchanging device in contact with or in communication with the heat accumulative object and further in communication with the fluid outlet; and a fluid pump as described above.

BRIEF DESCRIPTION OF THE DRAWINGS

The above contents of the present invention will become more readily apparent to those ordinarily skilled in the art after reviewing the following detailed description and accompanying drawings, in which:

FIG. 2A and FIG. 2B are top and bottom perspective views schematically illustrating a conventional impeller included in the water pump of FIG. 1;

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
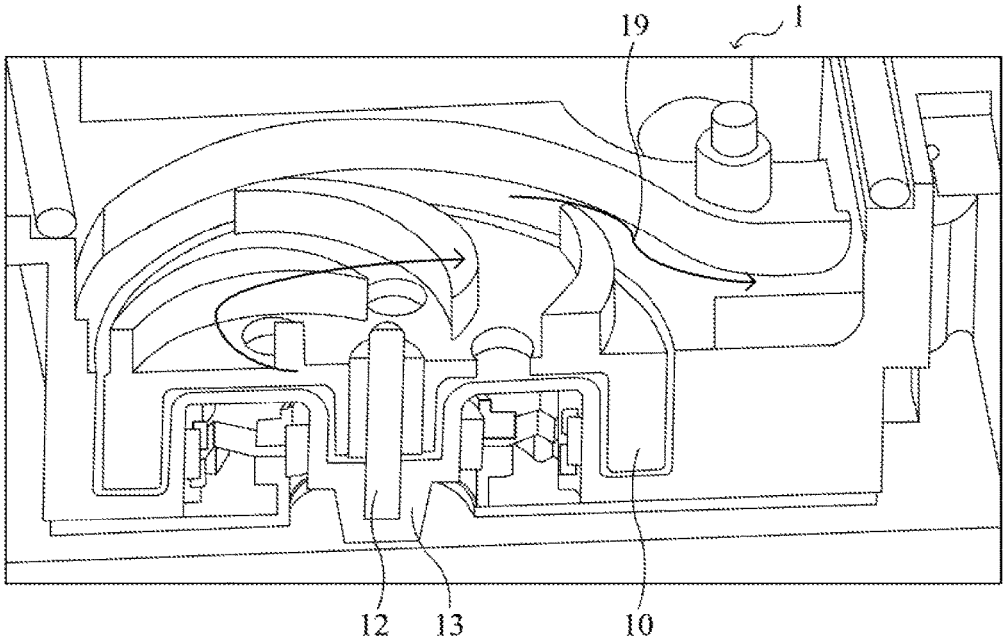
FIG. 1 (Prior Art)
FIG. 1 is a cross-sectional view schematically illustrating a water pump commonly used in a water cooling heat-dissipating system of a conventional IC chip.
Figure 3A:
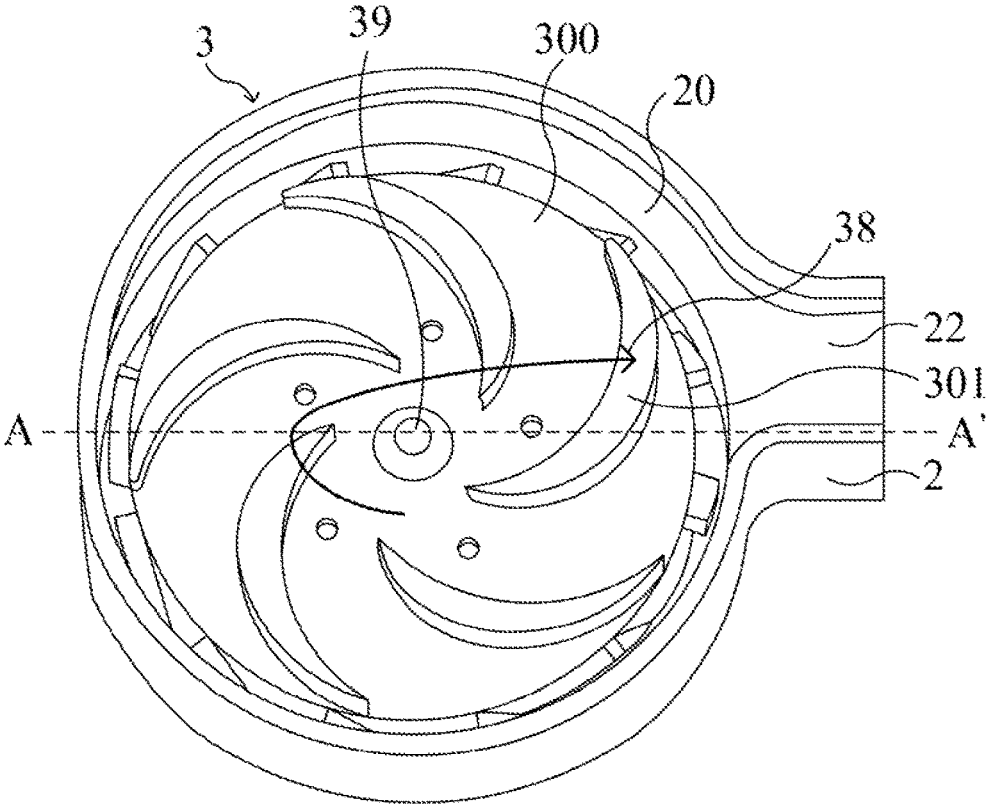
FIG. 3A is a top perspective view schematically illustrating a fluid pump according to an embodiment of the present invention.
Figure 3B:
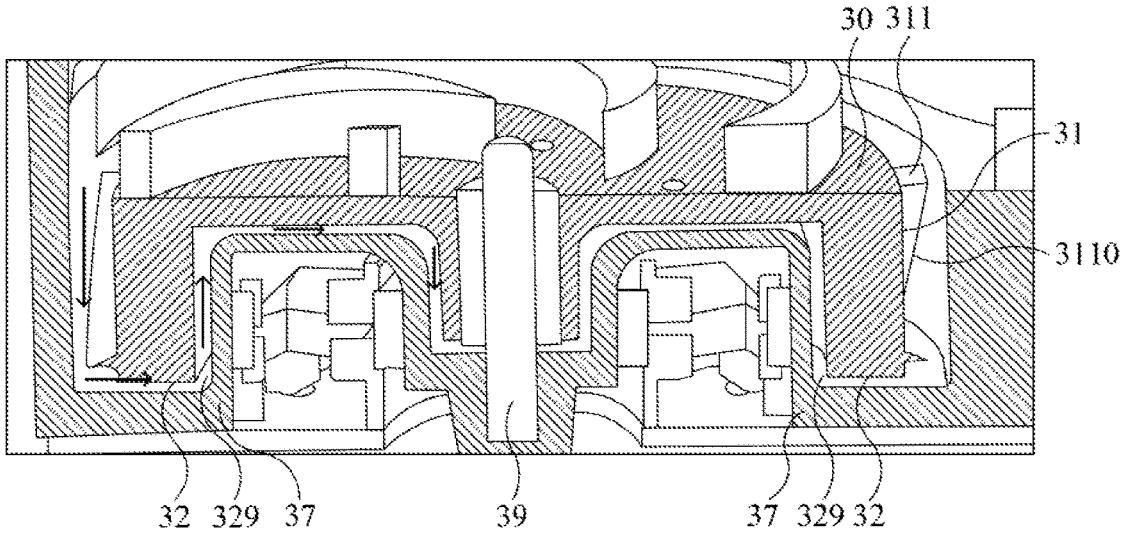
FIG. 3B is cross-sectional view schematically illustrating the fluid pump of FIG. 3A, taken along the A-A' line.

Referring to FIG. 3A and FIG. 3B, a fluid pump according to an embodiment of the present invention is schematically illustrated. The fluid pump, e.g. a water pump, includes a housing 2 and an impeller 3 installed in the housing 2. As shown in FIG. 3A, the impeller 3 engages with a shaft 39 and driven by the shaft 39 to rotate. A first set of blades 301 are disposed at a top 30 of an impeller body 300 as a first set of fluid guiding members for guiding the flow of the cooling liquid. In this embodiment, the first set of blades 301 are formed with a plurality of arc bumps of the same or similar shape, which are symmetrically arranged at the top 30 of the impeller body 300. Each of the arc bumps 301 is radially distributed, and oriented substantially opposite to the rotating direction of the impeller 3. For example, the impeller 3 shown in FIG. 3A rotates clockwise, and guides the fluid in a chamber 20 of the housing 2 to flow in a centrifugal direction of the shaft 39 toward a fluid outlet 22. An arrow 38 schematically exemplifies the flow direction of the fluid. In this embodiment, the impeller body 300 has a substantially cylindrical contour. The top 30 and the circumferential surface 31 constitute the top and the circumference of the cylinder. A space 329 is defined between the bottom 32 of the impeller body 300 and an inner wall 37 of the fluid pump, where the impeller 3 is supported. The shaft 39 is centrally installed in the cylinder, penetrates through the impeller body 300 and supported by the inner wall 37.

Figure 4A:
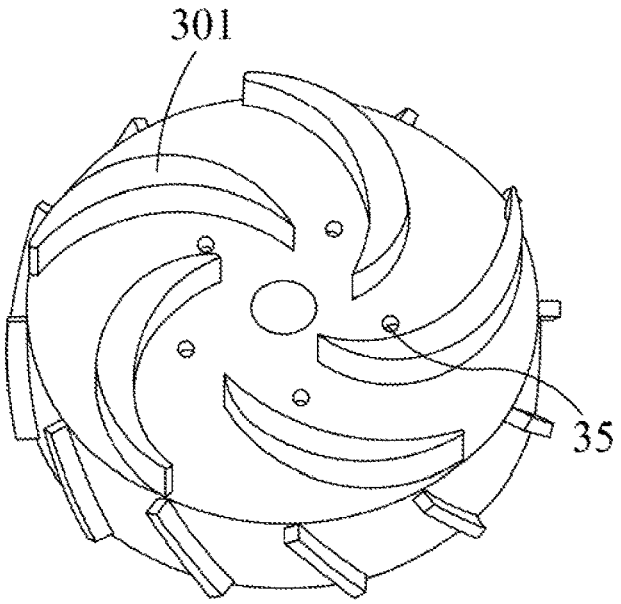
FIG. 4A and FIG. 4B are top and bottom perspective views schematically illustrating an impeller according to a first embodiment of the present invention, adapted to be used in the water pump of FIG. 3.
Figure 4B:
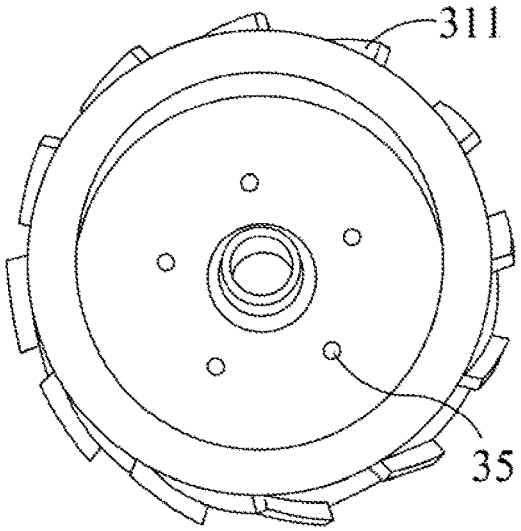

Further referring to FIG. 4A and FIG. 4B, top and bottom perspective views of the impeller are schematically illustrated. The impeller 3 further includes a second set of blades 311 disposed on a circumferential surface 31 thereof as a second set of fluid guiding members for guiding the fluid to flow from the top to the bottom of the impeller into the space 329 along a designated path on the circumferential surface 319. At least one of the second set of blades 311 is implemented with a linear bump having a tilting structure. For example, each of the blades 311 has a slant surface 3110 tapering from the top 30 to the bottom 32. Furthermore, the slant surface 3110 goes up along the rotating direction of the impeller 3. The specifically configured slant surface 3110 guides a portion of fluid to flow from the top 30 toward the bottom 32 by way of the circumferential surface 31 in order to maintain a liquid pressure in the space 329 at the bottom 32 of the impeller body 300, thereby stabilizing the rotation of the impeller 3.

Furthermore, in order to readily vent the air existing in the bottom space 329 of the impeller 3 and reserve room for the heat-dissipating liquid, through holes 35 are created in the impeller body 300. The through holes have a diameter smaller than that of the through holes existent in the prior art, which is about 1 millimeter or less. The reduction of the size of the through holes is advantageous in the structural strength of the impeller. Nevertheless, the size, number and allocation of the through holes may vary with practical requirement, e.g. the property of the fluid or the revolving speed of the impeller. The design of the second set of blades 311 further facilitates the venting of air, thereby maintaining the liquid pressure level in the bottom space 329. Under this circumstance, the through holes 35 may be omitted with little pressure loss.

Figure 5A:
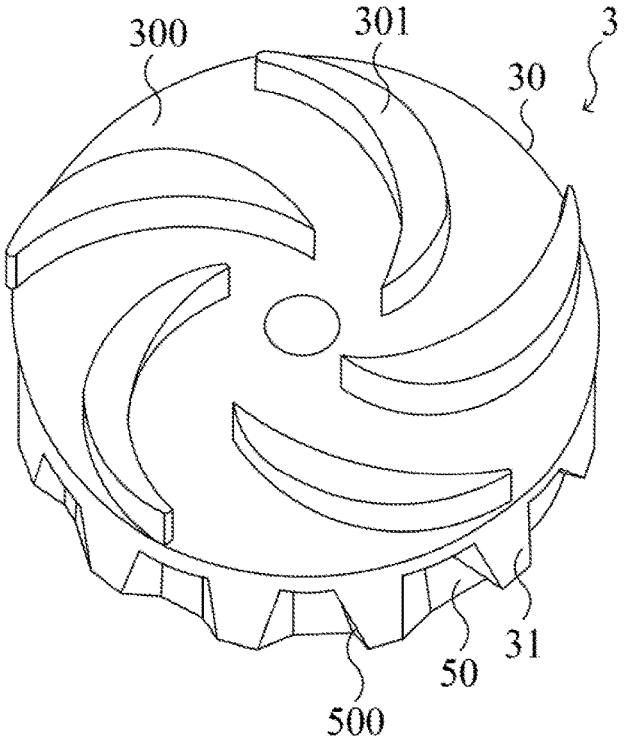
FIG. 5A and FIG. 5B are top and bottom perspective views schematically illustrating an impeller according to a second embodiment of the present invention, adapted to be used in the water pump of FIG. 3.
Figure 5B:
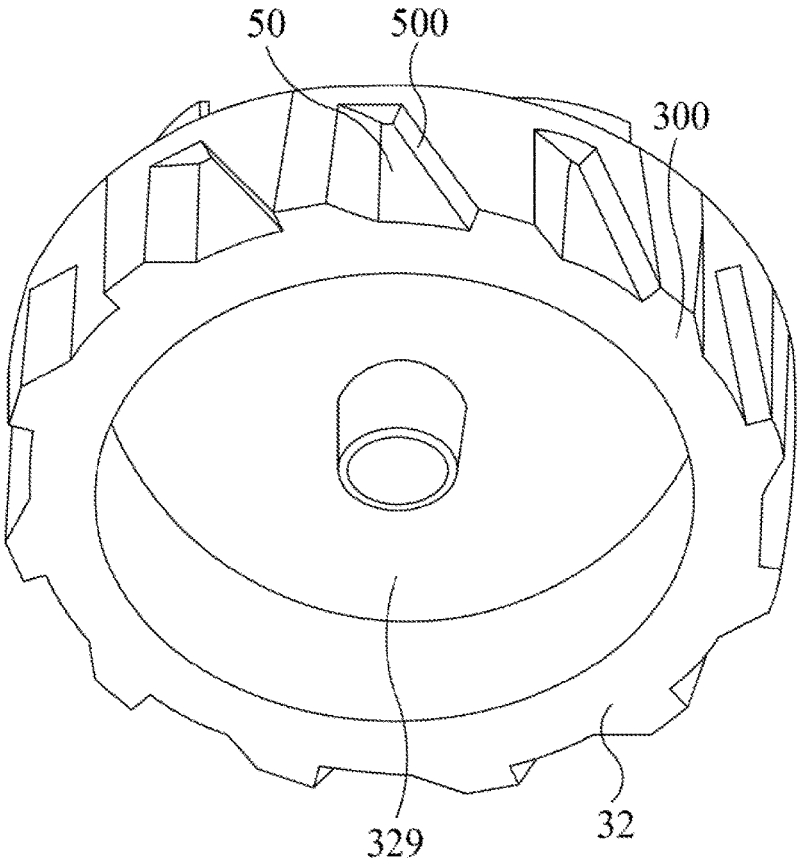

FIG. 5A and FIG. 5B schematically illustrate an impeller according to a second embodiment of the present invention, adapted to be used in the water pump of FIG. 3. The lateral blades 311 included in the above-described impeller 3 are replaced with trenches 50 in this embodiment for functioning as the second set of fluid guiding members. The trenches 50 are created on the circumferential surface 31 of the impeller body 300 for guiding the fluid to flow from the top to the bottom of the impeller along a designated path on the circumferential surface 31. For this purpose, a slant surface 500 is created in the trench 50. For example, the slant surface 500 may be one of the internal walls of the trench 50. Likewise, the slant surface 500 tapers from the top 30 to the bottom 32, and the slant surface 500 goes up along the rotating direction of the impeller 3. The specifically configured slant surface 500 guides a portion of fluid to flow from the top 30 toward the bottom 32 by way of the circumferential surface 31 in order to maintain a liquid pressure in the space 329 at the bottom 32 of the impeller body 300, thereby stabilizing the rotation of the impeller 3. In addition, the design of the trenches 50 further facilitates the venting of air, thereby maintaining the liquid pressure level in the bottom space 329. Through holes can thus be omitted.

Figure 6:
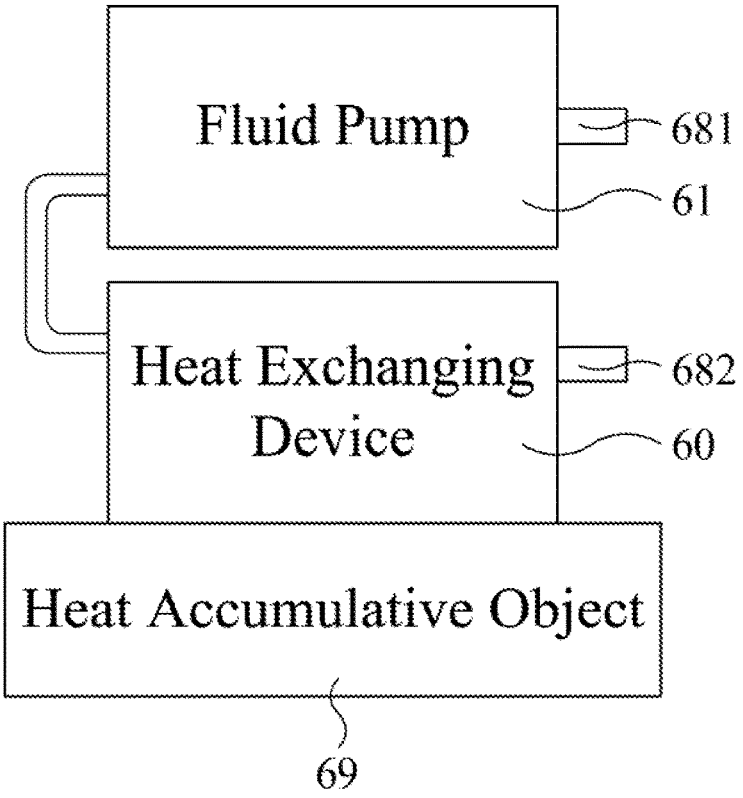
FIG. 6 is a functional block diagram schematically illustrating a liquid cooling system including an impeller according to the present invention.

FIG. 6 schematically illustrates an embodiment of a liquid cooling system according to the present invention, which is used for dissipating heat from a heat-accumulative object 69. The heat-accumulative object, for example, is an electronic element such as an IC chip. The liquid cooling system includes a heat exchanging device 60 in contact or in communication with the heat-accumulative object 69, and a fluid pump 61 in communication with the heat exchanging device 60. For dissipating heat, a cooling liquid enters the liquid cooling system from an inlet 681 in communication with the fluid pump 61, passes through the fluid pump 61 and the heat exchanging device 60, and then exits the liquid cooling system from an outlet 682 in communication with the heat exchanging device 60. Any of the above-described embodiments of impellers or their alternatives may be used in the liquid cooling system to guide the cooling liquid into the heat exchanging device 60. The details of the impellers are not to be redundantly described herein. The heat exchanging device 60 and the fluid pump 61 may be separately disposed in different chambers. Alternatively, they may be integrally disposed in the same chamber.

Figure 7A:
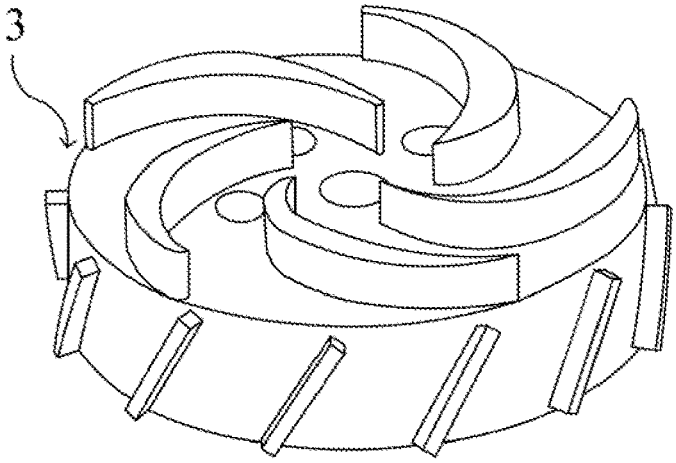
FIG. 7A and FIG. 7B are top and bottom perspective views schematically illustrating an impeller according to a third embodiment of the present invention.
Figure 7B:
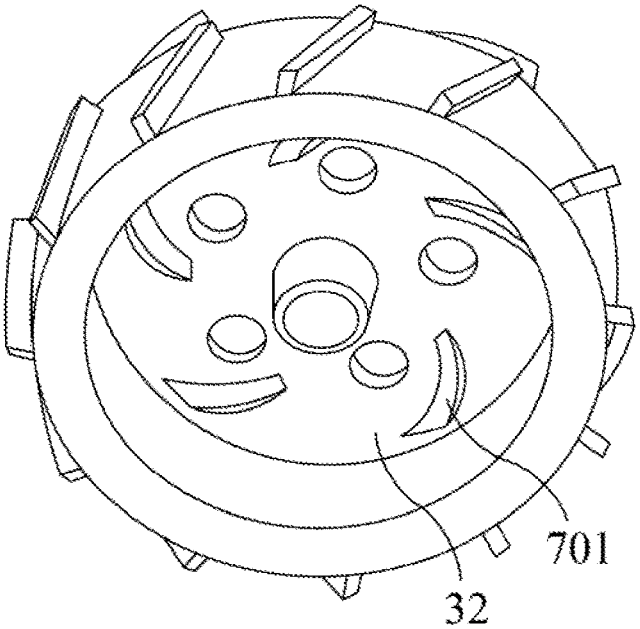

FIG. 7A and FIG. 7B are top and bottom perspective views schematically illustrating an impeller according to a third embodiment of the present invention. This embodiment of impeller is similar to that one illustrated in FIGS. 4A and 4B except that a third set of fluid guiding members are further included. The third set of guiding members are implemented with arc recesses 701 in this embodiment, which are disposed on the bottom surface 32 of the impeller body 300. The arc recesses 701 substantially have the same shape and are preferably evenly distributed on the bottom surface 32 of the impeller body 300. Each of the arc recesses 701 is radially distributed, and oriented substantially opposite to the rotating direction of the impeller 3. For example, the impeller 3 shown in FIG. 7A rotates clockwise, and guides the fluid at the bottom of the impeller body 300 to flow downwards and outwards. As such, the floating problem resulting from a high fluid pressure at the bottom of the impeller body 300 can be avoided, so the stable resolution of the impeller can be maintained.

Figure 8A:
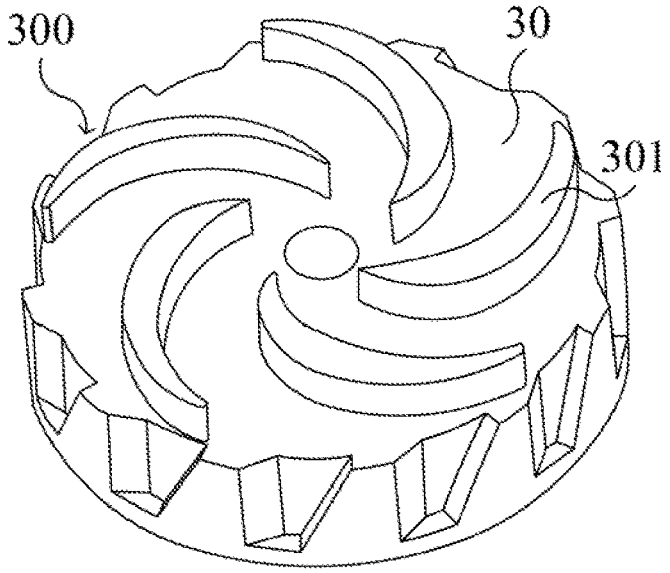
FIG. 8A and FIG. 8B are top and bottom perspective views schematically illustrating an impeller according to a fourth embodiment of the present invention.
Figure 8B:
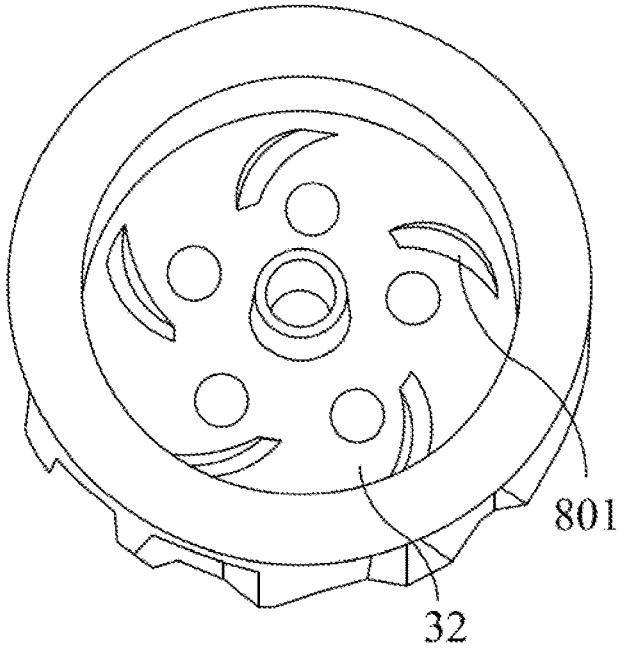

FIG. 8A and FIG. 8B are top and bottom perspective views schematically illustrating an impeller according to a fourth embodiment of the present invention. This embodiment of impeller is similar to that one illustrated in FIGS. 5A and 5B except that a third set of fluid guiding members are further included. The third set of guiding members are implemented with arc recesses 801 in this embodiment, which are disposed on the bottom surface 32 of the impeller body 300. The arc recesses 801 substantially have the same shape and are preferably evenly distributed on the bottom surface 32 of the impeller body 300. Each of the arc recesses 801 is radially distributed, and oriented substantially opposite to the rotating direction of the impeller 3. For example, the impeller 3 rotates clockwise, and guides the fluid at the bottom of the impeller body 300 to flow downwards and outwards. As such, the floating problem resulting from a high fluid pressure at the bottom of the impeller body 300 can be avoided, so the stable resolution of the impeller can be maintained.

With the specific designs, the impeller according to any of the above-described embodiments of the present invention, the fluid pump using the impeller, and liquid cooling system including the fluid pump are advantageous in stable internal pressure, smooth revolving operation and minimized friction between the shaft and bearing. The imbalanced revolving operation and wearing damage problems commonly occurring in the prior art can be ameliorated. Furthermore, the impeller can be applied to a variety of fluid pumps and liquid cooling systems.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An impeller for used in a fluid pump, comprising:

a shaft controlled to revolve in a first direction;

an impeller body coupled to the shaft and driven by the revolving shaft to rotate, the impeller body having a top surface, a bottom surface and a circumferential surface;

a first set of fluid-guiding members disposed on the top surface of the impeller body for driving a fluid to flow along a centrifugal direction of the revolving shaft; and a second set of fluid-guiding members disposed on the circumferential surface of the impeller body, and having at least one titling structure for driving a portion of the fluid to flow from the top to the bottom of the impeller along a designated path on the circumferential surface;

wherein the impeller body has a substantially cylindrical contour, the top surface and the circumferential surface are top and circumferential surfaces of the cylinder, and the shaft is centrally installed in the cylinder.

2. The impeller according to claim 1, further comprising at least one through hole penetrating through the impeller body from the top surface to the bottom surface, wherein a diameter of the through hole is less than 1 millimeter.

3. The impeller according to claim 1, wherein the impeller body is driven by the revolving shaft to rotate in the first direction, and the first set of fluid-guiding members include a plurality of arc bumps of the same or similar shape, which are symmetrically arranged on the top surface of the impeller body, and each of which is radially distributed and oriented in a second direction substantially opposite to the first direction.

4. The impeller according to claim 1, wherein the impeller body is driven by the revolving shaft to rotate in the first direction, and the second set of fluid-guiding members include at least one linear bump having a slant surface as a tilting structure, and the slant surface goes up along the first direction.

5. The impeller according to claim 1, wherein the impeller body is driven by the revolving shaft to rotate in the first direction, and the second set of fluid-guiding members include at least one trench having a slant internal wall as a tilting structure, and the slant internal wall goes up along the first direction.

6. The impeller according to claim 1, further comprising a third set of fluid-guiding members, wherein the impeller body is driven by the revolving shaft to rotate in the first direction, and the third set of fluid-guiding members include a plurality of arc recesses of the same or similar shape, which are symmetrically arranged on the bottom surface of the impeller body, and each of which is radially distributed and oriented in a second direction substantially opposite to the first direction.

7. A fluid pump, comprising:

a housing including a chamber, a fluid inlet and a fluid outlet, the fluid inlet and the fluid outlet being in communication with the chamber; and an impeller, comprising:

a shaft controlled to revolve in a first direction;

an impeller body accommodated in the chamber and coupled to the shaft, the impeller being driven by the revolving shaft to rotate, the impeller body having a top surface, a bottom surface and a circumferential surface;

a first set of fluid-guiding members disposed on the top surface of the impeller body for driving a fluid to flow along a centrifugal direction of the revolving shaft; and a second set of fluid-guiding members disposed on the circumferential surface of the impeller body, and having at least one titling structure for driving a portion of the fluid to flow from the top to the bottom of the impeller along a designated path on the circumferential surface;

wherein the impeller body has a substantially cylindrical contour, the top surface and the circumferential surface are top and circumferential surfaces of the cylinder, and the shaft is centrally installed in the cylinder.

8. The fluid pump according to claim 7, further comprising at least one through hole penetrating through the impeller body from the top surface to the bottom surface, wherein a diameter of the through hole is less than 1 millimeter.

9. The fluid pump according to claim 7, wherein the impeller body is driven by the revolving shaft to rotate in the first direction, and the first set of fluid-guiding members include a plurality of arc bumps of the same or similar shape, which are symmetrically arranged on the top surface of the impeller body, and each of which is radially distributed and oriented in a second direction substantially opposite to the first direction.

10. The fluid pump according to claim 7, wherein the impeller body is driven by the revolving shaft to rotate in the first direction, and the second set of fluid-guiding members include at least one linear bump having a slant surface as a tilting structure, and the slant surface goes up along the first direction.

11. The fluid pump according to claim 7, wherein the impeller body is driven by the revolving shaft to rotate in the first direction, and the second set of fluid-guiding members include at least one trench having a slant internal wall as a tilting structure, and the slant internal wall goes up along the first direction.

12. The fluid pump according to claim 7, further comprising a third set of fluid-guiding members, wherein the impeller body is driven by the revolving shaft to rotate in the first direction, and the third set of fluid-guiding members include a plurality of arc recesses of the same or similar shape, which are symmetrically arranged on the bottom surface of the impeller body, and each of which is radially distributed and oriented in a second direction substantially opposite to the first direction.

13. A liquid cooling system for dissipating heat from a heat accumulative object, comprising:

a heat exchanging device in contact with or in communication with the heat accumulative object; and a fluid pump in communication with the heat exchanging device, the fluid pump comprising:

a housing including a chamber, a fluid inlet and a fluid outlet, the fluid inlet and the fluid outlet being in communication with the chamber, the fluid inlet being in communication with the fluid pump, and the fluid outlet being in communication with the heat exchanging device; and an impeller for guiding a liquid cooling fluid into the heat exchanging device, comprising:

a shaft controlled to revolve in a first direction;

an impeller body accommodated in the chamber and coupled to the shaft, the impeller being driven by the revolving shaft to rotate, the impeller body having a top surface, a bottom surface and a circumferential surface;

a first set of fluid-guiding members disposed on the top surface of the impeller body for driving a fluid to flow along a centrifugal direction of the revolving shaft; and a second set of fluid-guiding members disposed on the circumferential surface of the impeller body, and having at least one titling structure for driving a portion of the fluid to flow from the top to the bottom of the impeller along a designated path on the circumferential surface;

wherein the impeller body has a substantially cylindrical contour, the top surface and the circumferential surface are top and circumferential surfaces of the cylinder, and the shaft is centrally installed in the cylinder.

14. The liquid cooling system according to claim 13, further comprising at least one through hole penetrating through the impeller body from the top surface to the bottom surface, wherein a diameter of the through hole is less than 1 millimeter.

15. The liquid cooling system according to claim 13, wherein the impeller body is driven by the revolving shaft to rotate in the first direction, and the first set of fluid-guiding members include a plurality of arc bumps of the same or similar shape, which are symmetrically arranged on the top surface of the impeller body, and each of which is radially distributed and oriented in a second direction substantially opposite to the first direction.

16. The liquid cooling system according to claim 13, wherein the impeller body is driven by the revolving shaft to rotate in the first direction, and the second set of fluid-guiding members include at least one linear bump having a slant surface as a tilting structure, and the slant surface goes up along the first direction.

17. The liquid cooling system according to claim 13, wherein the impeller body is driven by the revolving shaft to rotate in the first direction, and the second set of fluid-guiding members include at least one trench having a slant internal wall as a tilting structure, and the slant internal wall goes up along the first direction.

18. The liquid cooling system according to claim 13, further comprising a third set of fluid-guiding members, wherein the impeller body is driven by the revolving shaft to rotate in the first direction, and the third set of fluid-guiding members include a plurality of arc recesses of the same or similar shape, which are symmetrically arranged on the bottom surface of the impeller body, and each of which is radially distributed and oriented in a second direction substantially opposite to the first direction.

19. The liquid cooling system according to claim 13, wherein the heat exchanging device and the fluid pump are separately accommodated in different chambers.

20. An impeller for used in a fluid pump, comprising:

a shaft controlled to revolve in a first direction;

an impeller body coupled to the shaft and driven by the revolving shaft to rotate, the impeller body having a top surface, a bottom surface and a circumferential surface;

a first set of fluid-guiding members disposed on the top surface of the impeller body for driving a fluid to flow along a centrifugal direction of the revolving shaft;

a second set of fluid-guiding members disposed on the circumferential surface of the impeller body, and having at least one titling structure for driving a portion of the fluid to flow from the top to the bottom of the impeller along a designated path on the circumferential surface; and at least one through hole penetrating through the impeller body from the top surface to the bottom surface, wherein a diameter of the through hole is less than 1 millimeter.

21. An impeller for used in a fluid pump, comprising:

a shaft controlled to revolve in a first direction;

an impeller body coupled to the shaft and driven by the revolving shaft to rotate, the impeller body having a top surface, a bottom surface and a circumferential surface;

a first set of fluid-guiding members disposed on the top surface of the impeller body for driving a fluid to flow along a centrifugal direction of the revolving shaft;

a second set of fluid-guiding members disposed on the circumferential surface of the impeller body, and having at least one titling structure for driving a portion of the fluid to flow from the top to the bottom of the impeller along a designated path on the circumferential surface; and a third set of fluid-guiding members, wherein the impeller body is driven by the revolving shaft to rotate in the first direction, and the third set of fluid-guiding members include a plurality of arc recesses of the same or similar shape, which are symmetrically arranged on the bottom surface of the impeller body, and each of which is radially distributed and oriented in a second direction substantially opposite to the first direction.

* * * * *